US005078174A

United States Patent [19]

Grooms et al.

[11] Patent Number: 5,078,174

[45] Date of Patent: Jan. 7, 1992

[54] VACUUM SEWERAGE SYSTEM HAVING NON-JAMMING VACUUM VALVES WITH TAPERED PLUNGERS

[75] Inventors: John M. Grooms; Mark A. Jones, both of Rochester, Ind.

[73] Assignee: Burton Mechanical Contractors, Inc., Rochester, Ind.

[21] Appl. No.: 555,231

[22] Filed: Jul. 18, 1990

Related U.S. Application Data

[63] Continuation-in-part of Ser. No. 366,585, Jun. 15, 1989, abandoned.

[51] Int. Cl.[5] ..... F16K 31/126; E03F 3/00

[52] U.S. Cl. ..... 137/205; 137/236.1; 137/907; 251/61.5

[58] Field of Search ..... 137/205, 236.1, 907; 251/61.5

[56] References Cited

U.S. PATENT DOCUMENTS

| | | | |
|---|---|---|---|
| 3,807,431 | 4/1974 | Svanteson | 137/205 |
| 4,171,853 | 10/1979 | Cleaver et al. | 281/61.5 X |
| 4,179,371 | 12/1979 | Foreman et al. | 137/236.1 X |
| 4,373,838 | 2/1983 | Foreman et al. | 137/236.1 X |
| 4,826,132 | 5/1989 | Moldenhauer | 251/333 X |

*Primary Examiner*—Gerald A. Michalsky
*Attorney, Agent, or Firm*—Jones, Day, Reavis & Pogue

[57] ABSTRACT

An improved vacuum sewerage system for transmitting sewage, including at opposite ends a sewage collection tank at atmospheric pressure and a vacuum collection tank under vacuum pressure. The sewage is intermittently injected into a transport conduit under vacuum or subatmospheric pressure when a non-jamming vacuum control valve interposed in the conduit is opened in response to a predetermined pressure condition. The conduit is laid out in a saw-toothed fashion, having a riser, a low point, and a downslope. When no sewage is being transported through the conduit, any residual sewage collects in the low point, which generally does not completely fill with sewage so that vacuum or subatmospheric pressure is communicated throughout the conduit. When the control valve is opened, the sewage transported through the conduit forms a generally hollow cylindrical mass, which is propelled toward the vacuum collection tank. The control valve has a substantially tapered, rigid plunger, and will not jam in the open or semi-open position as a result of repetitive cycling of the valve by an associated control unit. The plunger is mounted at one end of an axially disposed shaft of a piston operator in the valve chamber, and the valve is sealed to prevent leakage of air or liquids. The non-jamming valve is capable of facilitating a flow rate of thirty gallons per minute. The combined vacuum valve and vacuum transport system may be used to convey other types of collected waste liquid, such as used cutting oils.

18 Claims, 4 Drawing Sheets

10
12
14
16
18
20
22
24
26
28
30
32
34

VACUUM SEWERAGE SYSTEM HAVING NON-JAMMING VACUUM VALVES WITH TAPERED PLUNGERS

CROSS-REFERENCE TO RELATED APPLICATION

This is a continuation-in-part of U.S. patent application Ser. No. 366,585, filed on June 15, 1989, in the names of John M. Grooms and Mark A. Jones, now abandoned.

BACKGROUND OF THE INVENTION

The present invention relates generally to sewage systems, and more particularly, to sewage systems which utilize differential air pressure to create flow therein, and have inlet vacuum valves with a tapered plunger to prevent valve jamming and subsequent air leakage as the vacuum seal is impaired.

Sewage systems initially were gravity operated, including a network of underground pipes leading from various sources of waste (e.g., homes, businesses, etc.) to a sewage treatment plant. However, irregular terrains and distances posed between the entry and collections points of the waste significantly limited the ability to dig deep trenches to provide a continuous, downhill flow of sewage. Thus, mechanical pumps were placed at strategic points along the pipe network to provide a positive force behind waste flowing in a more-shallowly laid piping network. In actuality, though, pressure pumps were needed at every sewage input point for such a system.

Vacuum-operated systems were proposed as an alternative, as exemplified by U.S. Pat. No. 3,115,148 issued to S.A.J. Liljendahl. The Liljendahl patent describes a vacuum system which uses two separate piping networks to carry different effluent streams. While the waste products from bathtubs, wash basins, sinks, etc. (gray water), are conveyed by a conventional gravity system, waste products discharged from water closet bowls, urinals, and similar sanitary apparati (black water) are transported by a separate, vacuum system. The conduits in the latter system are provided with "pockets" in which sewage is collected so as to form a plug which entirely fills the cross-sectional area of the pipe and effects conduit closure. A plug of sewage is moved by a pressure differential force along a conduit in an integral condition. The kind of vacuum-operated system taught by the Liljendahl patent is called "plug flow."

U.S. Pat. No. 3,730,884, issued to B. C. Burns et al., describes a sewage system using "vacuum-induced plug flow" in which both black water and gray water are handled by a single piping system. A "coherent plug" of sewage is transported by a vacuum pressure differential through a pipe for a short distance. The plug will disintegrate, however, as it moves through the pipe due to friction and other forces, resulting in a diminishment of the pressure differential moving the plug. Therefore, a series of plug reformers, which in their simplest form may be a dip or pocket in the pipe, serve as a trap for sewage and aid in the reformation of a coherent plug. The pockets are designed so that sewage entirely fills the pipe bore. Operation of the system requires that the plug of sewage seal the pipe bore. This process of alternate plug disintegration and reformation continues until the sewage eventually passes completely through the pipe. The pressure differential for each of these plugs is less than the total available system pressure differential because of the serial arrangement of the plug pockets in a pipe.

U S Pat. No. 4,179,371, issued to B. E. Foreman et al., describes an apparatus and method for transporting sewage from a source of sewage to a collection means. A pressure differential is maintained in the piping between the source and the collection means. Sewage is transported through the conduit in the form of a generally hollow cylinder. When no sewage is being transported, the residual sewage retained in the conduit generally does not close the conduit and permits the same pressure to be maintained throughout the conduit. Injection means are provided, which may be a valve opened in response to a predetermined condition. The conduit is laid out in a saw-toothed configuration with a riser portion, a downslope portion, and a low point portion in which residual sewage not discharged from the system may collect. The residual sewage is generally insufficient to close the conduit, thereby permitting communication of the same pressure throughout the conduit. Thus, the apparatus, as disclosed by Foreman, may include a gravity-fed sewage collection tank at atmospheric pressure having its contents intermittently injected into a vacuum-pressurized conduit laid out in saw-toothed fashion, which permits full vacuum to be communicated throughout the conduit under typical operating conditions.

U.S. Pat. No. 3,807,431, issued to S. A. A. Svanteson, describes a device for conducting waste liquid from a receptacle tank to a pneumatic liquid disposal system. The device includes a vacuum valve, consisting of a wye-body conduit with a diaphragm defining an upper housing. A spring biases the diaphragm against the valve stop of the conduit to close the valve and produce a seal. However, because a portion of the bottom side of the diaphragm is in communication with the vacuum pressure condition existing in the downstream portion of the conduit while the valve is closed, when the same vacuum pressure condition is introduced to the upper chamber, there will be little pressure differential to move the diaphragm in an upwards direction and, indeed, any pressure differential must overcome the downward, positive force exerted by the spring. Thus, if the control valve does open in response to the application of differential pressure, it only will do so partially, which promotes blockage of the valve as the waste liquid passes through. In general, the vacuum valve as taught by Svanteson will not open fully until the waste liquid has already passed by and air at atmospheric pressure is subsequently transported through the valve and conduit. This condition of partial opening of the control valve is an inherent problem with Svanteson, which can deleteriously affect the operation of the vacuum sewerage transport system.

U.S. Pat. No. 4,171,853, issued to D. D. Cleaver et al., describes a general structure and method of operation of a vacuum valve device for sealing and unsealing the conduit at the point of injection of sewage into the system. A controller assembly is attached to the valve. Once the valve opens in response to a signal received from the controller unit, accumulated sewage flows into the vacuum sewerage system to a remote collection station for subsequent transfer to a facility. These vacuum valves are closed to seal the vacuum system from atmospheric pressure by allowing atmospheric pressure to enter the internal upper housing chamber of the vacuum valve in response to a signal from the associated control unit to cause the closing of a rigid, plastic, internal plunger located within a centrally disposed valve chamber. Movement of the plunger is aided by an internal spring member located inside the upper housing of the valve unit. The plunger, as taught by Cleaver, is usually cylindrical in shape and operatively connected to the lower end of a piston driving member positioned against the spring.

The use of a cylindrically-shaped plunger head, however, presents a number of problems. Small stones, chips, and other solid particles are present in the various connecting pipes within the vacuum sewerage system. Yet, the physical clearance between the rigid cylindrical plunger and the wall of the vacuum valve chamber is sufficiently large that small stones, chips, solid particulate matter, rags, etc. can lodge between the valve chamber wall and the plunger as the waste matter is transported during operation of the system. Occasionally, this causes the cylindrical plunger to be jammed against the wall of the internal valve chamber while the vacuum valve is being pulled to the "open" position. Not only is the plunger damaged, but also the vacuum valve cannot be properly closed again in response to the signal from the controller unit. This condition results in continuous air and fluid leakage through the partially open vacuum valve and improper operation of the valve. Moreover, the leaking air and fluid will impair efficient operation of the overall vacuum transport system by destroying the pressure differential within the conduit downstream from the partially open valve. Proper operation of the system may only be restored once maintenance personnel identify which of the numerous valves have failed and service each one of those valves, a time consuming and cumbersome job.

Furthermore, under repetitive vacuum cycling, the rubber seat at the end of the plastic, cylindrical plunger, which physically engages the internal valve stop of the wye-body conduit pipe when the vacuum valve is in the "closed" position, tends to be pulled away from the end of the cylindrical plunger as the vacuum valve is opened. This allows small stones, chips, and other solid particles to become lodged between the rubber seat and the end of the plastic cylindrical plunger. This condition interferes with proper closure of the vacuum valve, thereby causing leakage when the valve is in the "closed" position.

The internal valve stop of the wye-body conduit pipe, as shown in the vacuum valve of the prior art, is positioned adjacent to, and below, the rubber seat at the end of the plastic cylindrical plunger, and will occasionally leak, thereby permitting unwanted air and fluid leakage into the system. In addition, because of the tight tolerance required between the internal valve stop of the wye-body and the rubber seat at the end of the cylindrical plunger, slight deviations in the angle of machining of the valve stop causes the cylindrical plunger incorrectly to engage the opposed valve stop of the wye-body. Thus, this incorrect seating can become yet another source of air and fluid leakage from the sump holding the accumulated waste liquid in the vacuum main.

And finally, the prior art vacuum valves have experienced leakage through the seal surrounding the operating shaft of the valve piston. This seal is provided between the internal valve chamber and lower housing chamber of the vacuum valve, preventing liquid or pressure communication therebetween. Leakage into the lower housing chamber permits fluid contamination into the control unit for the inlet vacuum valve by way of a connector tube which joins these two elements in common to an atmospheric air vent. This seepage damages the individual control unit over time. To the extent that sewage contamination leaks into the lower housing chamber of the vacuum valve, or into the associated control unit, maintenance of the vacuum valve is exacerbated, and system reliability is impaired.

All of these various problems with the proper operation of the vacuum valves of the prior art prevent "positive closure" of the valve by which the rubber seat attached to the plunger engages firmly with the internal valve stop of the wye-body conduit pipe in order to create an air-tight seal to promote a pressure differential across the valve and maintain a vacuum pressure condition downstream of the valve. Moreover, they cause labor costs associated with locating, servicing, and repairing damaged valves. Furthermore, the most expedient way to correct damaged cylindrical plungers is to remove and replace the entire vacuum valve, complicated by the fact that the valves and conduit lines are laid many feet below ground level. Any fluid contamination leaking into the vacuum valve will only increase these costs of repair.

OBJECT OF THE PRESENT INVENTION

Accordingly, a primary objective of the present invention is to provide an apparatus and method for a plugless vacuum sewerage transportation system.

Another object of the invention is to provide a sewage transport system which does not require extensive use of pumping stations to facilitate gravity flow of sewage.

In the system of the invention, pumps are not required at each source of sewage for injecting the sewage into a collection conduit.

Another object of the invention is to provide a system and method for transporting sewage in which a single, relatively small diameter pipe is used for plugless transportation of sewage without the need for plug reformers, and in which sewage is injected into the system by a pressure differential.

Yet another objective of the present invention is to provide an improved internal plunger for the vacuum valve used at the point of injection of sewage into the system, which will tolerate small stones and the like, while properly closing following cycling of the valve, and which will overcome the deficiencies experienced in the prior art systems. Still another objective of the present invention is to provide a vacuum valve which will not leak during normal repetitive cycling of the valve during vacuum system operation.

Yet another object of the invention is to provide a vacuum valve which will improve vacuum system reliability by enhancing the durability and ruggedness of the internal plunger of the vacuum valve.

SUMMARY OF THE INVENTION

Briefly, the invention is directed to providing an improved apparatus and method for transporting a mass of sewage from a source of sewage to collection means. A pressure differential is maintained between the source and the collection means. Sewage is injected into a conduit through a valve opened in response to a predetermined condition, and forms a hollow cylinder. When no sewage is being transported, the conduit has substantially the same pressure throughout. The conduit is laid out in a saw-toothed configuration with a riser portion, a downslope portion, and a low point portion in which residual sewage which was not swept through the conduit and discharged during the transport cycle collects at rest, thereby permitting communication of the same pressure throughout the conduit. According to another aspect of the invention, the apparatus includes a gravity-fed sewage collection tank at atmospheric pressure, having its contents intermittently injected through a valve into a vacuum-pressurized conduit laid out in saw-toothed fashion, which permits full vacuum to be communicated throughout the conduit.

The valve described above is non-jamming in nature, having an open and closed position. One of the valve elements is a flexible, rigid, substantially tapered, movable plunger. The lower end of the plunger has a flexible valve seat securely fastened to it at an angle to the central axis of the plunger. The seat of the movable plunger is designed to engage with and close an immovable mating valve stop element formed in a conduit or pipe of the sewage transportation system, having a first inlet opening at atmospheric pressure and a second outlet opening at vacuum or subatmospheric pressure. The vacuum valve components are sealed against fluid contamination.

In one embodiment of the non-jamming vacuum valve portion of the present invention, the valve comprises a piston, having a top end and a lower end opposite the top end and certain other component assemblies. Present is a screw plug and lower piston housing assembly comprising an O-ring of a predetermined size and tension, a screw plug to which the O-ring is attached, the screw plug having a top face, a wiper shaft seal of a predetermined size, a bearing which is secured to the top face of the screw plug after the wiper shaft seal is centrally secured to the bearing, another O-ring of a predetermined size and tension secured to the top face of the screw plug, and a lower piston housing which is secured to the top face of the screw plug. A separate upper piston housing assembly comprises a piston plate, a flexible rolling diaphragm having an outer flexible edge about its circumference, a C-shaped piston cup which nests within the rolling diaphragm, a spring member which is placed within the piston cup to bias the vacuum valve in the closed position, and an upper piston housing. The rolling diaphragm is operationally secured along its outer edge between the upper piston housing and the lower piston housing, the upper piston housing being operationally secured to the lower piston housing. There also exists certain wye-body conduit or pipe, adapted to receive the screw plug, and having a centrally disposed vacuum chamber into which the piston is fitted, the conduit having a first inlet end at atmospheric pressure and a second outlet end at vacuum or subatmospheric pressure, the wye-body conduit having an internal valve stop. A substantially tapered plunger is operationally secured to the lower end of the piston. The tapered plunger has a lower end; the lower end has a rubber valve seat secured thereto. The rubber valve seat physically engages the internal valve stop of the wye-body conduit when the vacuum valve is in the "closed" position, thereby sealing the vacuum system.

The combined vacuum valve and vacuum transport system may also be used to convey other types of collected waste liquids, such as used cutting oils.

BRIEF DESCRIPTION OF THE DRAWINGS

FIGS. *ia*, 1*b*, and 1*c* are schematic representations of a conduit of the invention, respectively, showing conduits having sewage flow generally uphill, on the level, and downhill.

DETAILED DESCRIPTION OF THE PREFERRED EMBODIMENT

Figures 1A, 1B, 1C, 2:
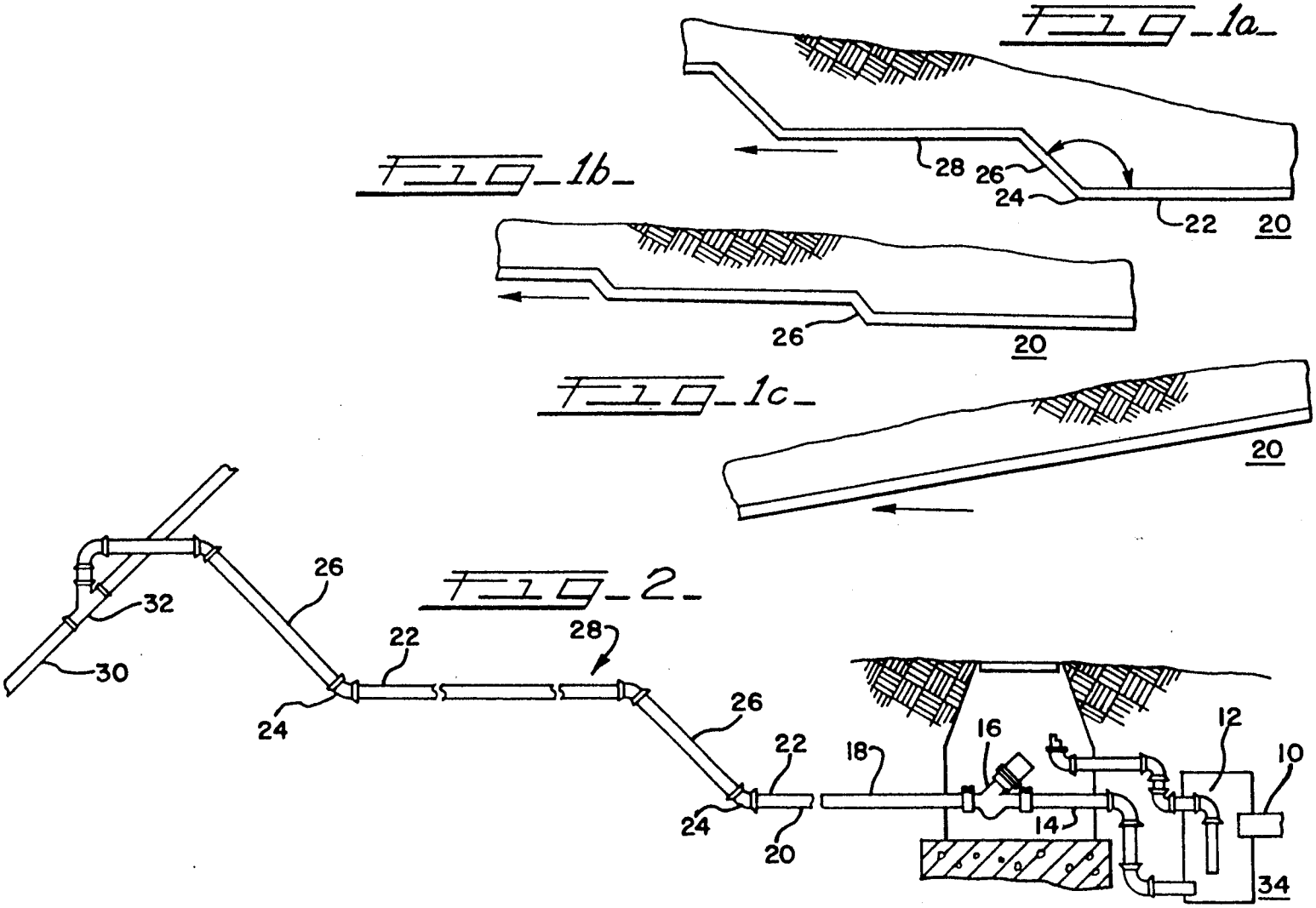
FIG. 2 is a side view of a portion of a system according to the invention in which a gravity-fed tank and an injection valve are located below a main vacuum conduit.

Referring now to FIGS. 1*a*, 1*b*, and 1*c* of the drawings, conduit sections for facilitating the flow of sewage in the directions of the arrows shown, (uphill, on the level, and downhill, respectively) are represented.

When the flow proceeds uphill as in FIG. 1*a*, the vacuum conduit 20 as shown has a very slight downward sloping portion 22, a low point portion 24, and a riser portion 26. Remnants of the sewage which are not swept through the conduit 20 and discharged in a sewage transport cycle flow to and accumulate in the low point portion 24. The conduits as shown in FIGS. 1*a* and 1*b* are laid out in generally saw-toothed configurations as shown. With the saw-toothed arrangement, the sewage residue will generally be insufficient to seal the conduit 20 bore when the sewage motion has ceased at the end of a transport cycle. This permits the same vacuum pressure to be maintained throughout the whole conduit, including that portion of the conduit above the material in the low portion 24 of the conduit.

The reduced pressure from the vacuum source is distributed throughout the main conduit 20, because the sewage does not form plugs which seal the bore of the conduit, permitting full vacuum differential pressure to be applied to sewage entering the vacuum system through the pressure differential control valve 16. This results in sewage velocities of from fifteen to eighteen feet per second, for example, when a ten to fifteen gallon volume of sewage enters such a system. Were the bore of the conduit 20 to be closed by a plug of sewage, as taught by the prior art, pressure differentials would be created along the conduit, and there would be greater resistance to sewage flow which would limit operation to shorter conduit lengths. The sewage, as previously mentioned, eventually takes the form of a hollow cylinder traveling through the conduit. The force of the sewage with the atmospheric air traveling behind it lifts all sewage trapped in the low point portions 24 up through the riser portions 26. FIG. 1*b* shows a system configured for essentially level terrain, having a somewhat shorter riser portion 26. FIG. 1*c* shows a system pipe for descending terrain and has no lift or riser portions. Various combinations of sections as shown in the figures may be utilized as required to form a multi-section system laid beneath irregular terrain.

FIG. 2 shows a portion of the system 34 according to the invention, encompassing the uphill-flow riser sections of piping as depicted in FIG. 1*a*, wherein like numbers represent similar system elements. Sewage from sources (not shown) is fed by gravity through pipes 10 to a gravity collection tank 12 in which sewage is stored temporarily. An outlet pipe 14 from the gravity collection tank 12 is connected to the inlet side of a pressure differential control valve 16 similar to the valve described in applicant's U.S. Pat. No. 4,171,853. The sewage in the gravity collection tank 12 is subjected to atmospheric pressure. In response to a predetermined system parameter, for example, a rise of the tank 12 level above a certain point, the pressure differential control valve 16 permits a volume of sewage to flow into a pipe 18.

A feeder vacuum conduit 28 having low point portions 24, riser potions 26, and downslope portions 22 provides lift as sewage is injected from the gravity collection tank 12 towards a main vacuum conduit 30 which is elevated above the gravity collection tank 12 as shown. The main vacuum conduit 30 is provided with reduced pressure by an appropriate vacuum source (not shown). Vacuum sewer main conduit 30, branches, and feeder conduit 28 may be constructed of, for example, polyvinyl chloride (PVC) or acrylonitrile-butadiene-styrene (ABS) plastic pipe. Joints may be solvent welded or provided with fittings having suitable vacuum-tight compression rings, as known in the art. For an installation with high sewage temperature, fiberglass pipe is used. Pipe sizes generally range between three and six inches in diameter. When lifts are required, the pipe downslopes are installed with a minimum slope of 0.2% between lift sections. Branch connections 32 to a main conduit 30 are made with vertical wye and ninety degree ell as shown. When sewage is injected into a conduit junction, some of the sewage initially moves in a reverse direction to the normal flow direction. The minimum slope of 0.2% in the downslope causes the backflow sewage to collect at a low point.

The conduit portion 30 downstream from the junction point 32 is straight and has no pocket formed therein. Thus, no obstacle is placed in the path of sewage swiftly passing through the pipe. The pressure differential control valve 16 is provided with timing means to maintain the valve in an open position for a period longer than that required to empty the contents of the gravity collection tank 12. This permits a quantity of atmospheric air, for example, twice the volume of sewage, to be injected into the main vacuum conduit 20 following the sewage mass. The sewage mass being transported through the conduit eventually takes the form of a hollow cylinder with the force initially exerted thereupon provided by the differential between atmospheric pressure and the reduced pressure of the vacuum source. As the sewage mass flows through the conduit, air pushes through the mass, thereby forming a hollow cylinder which continues moving through the conduit.

Figure 3:
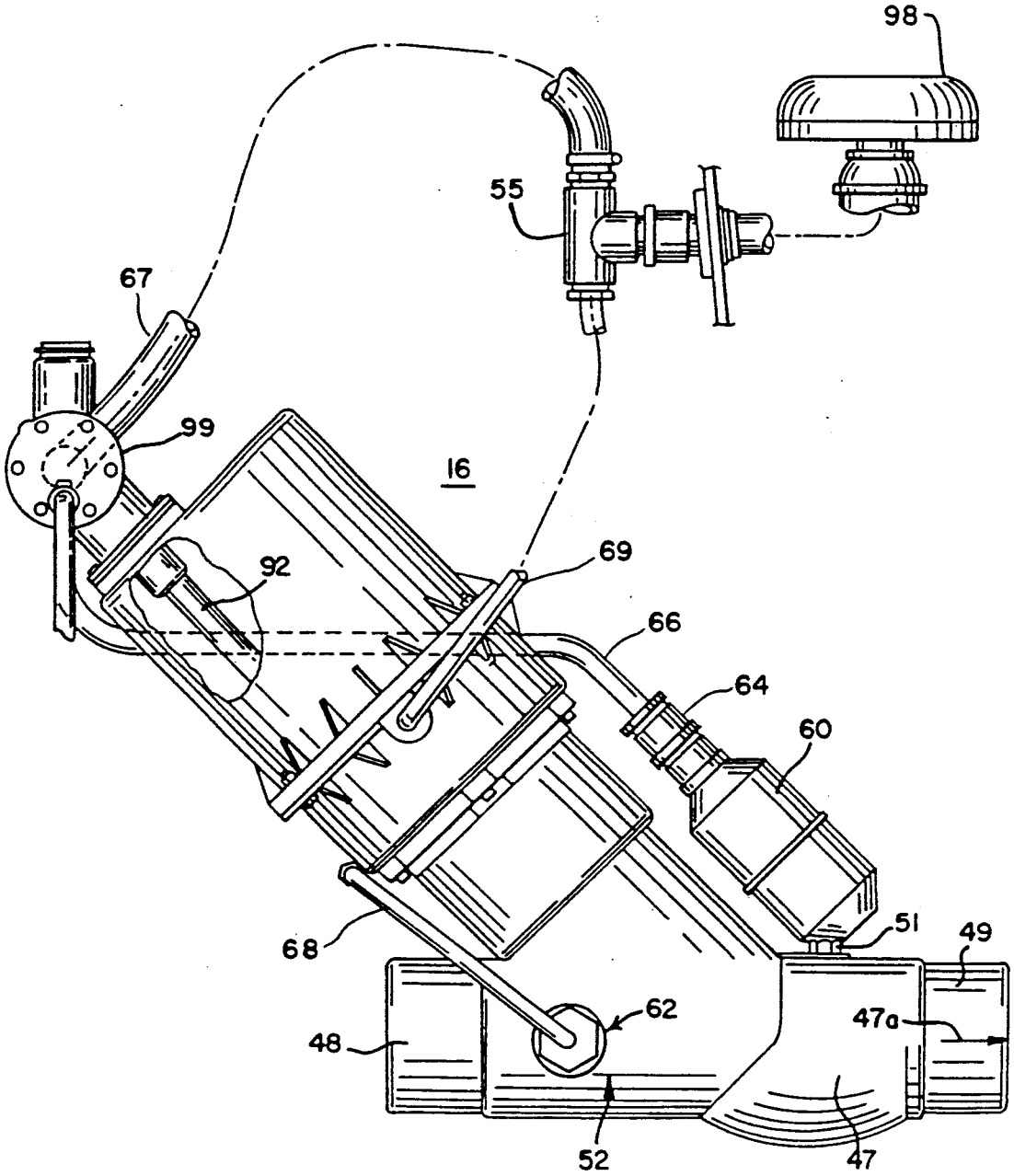
FIG. 3 is an enlarged, side-elevational view of the non-jamming vacuum valve of the present invention.

FIG. 3 illustrates vacuum valve 16 of the present invention, which is more fully described in applicants' co-pending application U.S. application Ser. No. 366,585, now abandoned. A pipe or wye-body conduit 52 contains the inlet vacuum valve, shown generally as 16, and is operatively connected at 48 to the outlet pipe 14 (from the gravity collection tank 12), which is at atmospheric pressure. It is connected at 49 to the transport service line 18 leading to the vacuum main, which is under vacuum or subatmospheric pressure at all times. A vacuum valve of this design and construction can operated at flow rates of about 30 gallons per minute.

The vacuum valve 16 has a surge tank 60 connected to the vacuum side of the wye-body 52 which is exposed at all times to the vacuum or subatmospheric pressure. Sewage flow will be in the direction of the arrow 47*a* projecting from front end 47 of wye-body 52. A connector member 51 connects the surge tank 60 to the front end 47 of the wye-body 52. Connected to the upper end of surge tank 60 are check valves 64, which in turn are attached to connector hose 66, which leads to unit controller 99 (mounted on top of the upper housing 83 of the inlet vacuum valve 16. Vacuum or subatmospheric pressure is delivered at all times to unit controller 99 from the front end 47 of the wye-body 52 via a path formed by the aggregated components.

When internal vacuum valve 16 is opened and the vacuum/subatmospheric pressure condition in wye-body conduit 52 immediately downstream of the valve begins to decrease due to atmospheric pressurized air passing through the valve into the vacuum transport lines, check valves 64 close to prevent vacuum or subatmospheric pressure in hose 66 from passing back into the vacuum transport line. Instead, the vacuum or subatmospheric pressure is delivered through hose 66 into unit controller 99. In this way, the effect of air and liquid surges that occur within the vacuum system is minimized, and the necessary vacuum/subatmospheric pressure condition in unit controller 99 is maintained, even though the actual vacuum or subatmospheric pressure in the distribution network (or the vacuum main) may be fluctuating during operation of the vacuum system, as normally will occur during the cycling of the inlet vacuum valve 16 to its opened and closed positions.

The surge tank 60 is a fusion welded assembly which is air-tight in construction. It is intended as a splash guard to collect any waste liquid which might splash through connector member 51 as the liquid is injected through the opened internal vacuum valve 16, and prevent the waste liquid from fouling check valves 64.

External breather pipe 98 provides a constant source of atmospheric pressure to the valve and unit controller assembly. Specifically, it is connected to tee connector 55, the two other ends of which are simultaneously connected to unit controller 99 and lower housing chamber 80 of internal vacuum valve 16 via atmospheric connector tubes 67 and 69, respectively. In this way, atmospheric pressure is delivered to the unit controller and lower housing chamber. The unit controller is more fully described in assignee's issued U.S. Pat. No. 4,373,838, while the importance of the lower housing chamber will be made clear shortly.

Atmospheric check valve 62 is positioned in back of the internal vacuum valve stop of wye-body 52. It is connected to hose 68, which in turn is connected to lower housing chamber 80. The upstream portion 48 of the wye-body 52 is always at atmospheric pressure when vacuum valve 16 is in the closed position, because it is attached to the branch transport line leading from the holding sump (which is at atmospheric pressure), and because it is connected to the lower housing chamber. However, the real need for atmospheric check valve 62 is to allow any condensation that may have formed in lower housing chamber 80 to drain through hose 68 into wye-body 52, and thereafter pass through internal vacuum valve 16 when it is opened to commence a sewage transport cycle. Otherwise, condensation build-up in lower housing chamber 80 might interfere with the maintenance of an atmospheric pressure condition therein.

Figure 4:
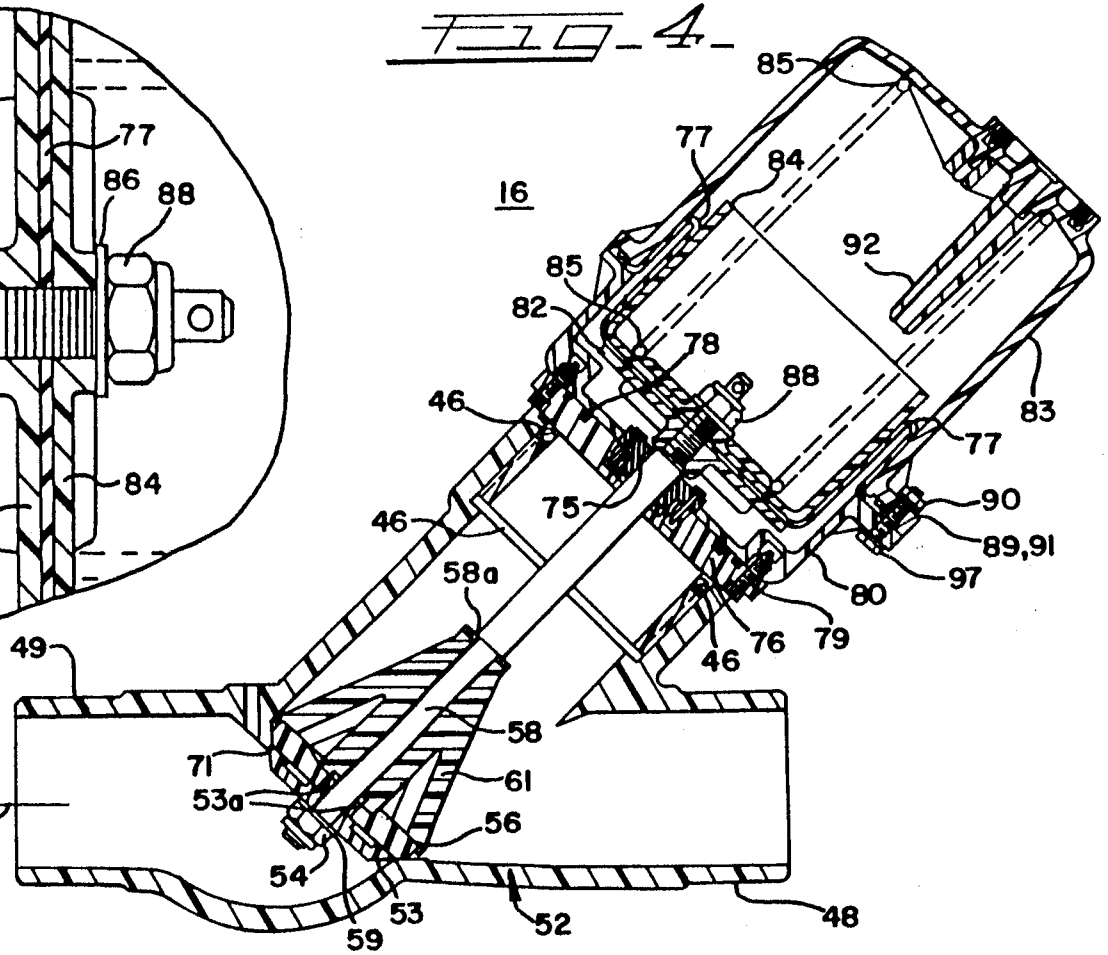
FIG. 4 is a partial cross-sectional view of the opposite side of the vacuum valve shown in FIG. 3, to illustrate the main cooperating components of the valve.

FIG. 4 illustrates the internal parts of vacuum valve 16 of the present invention. Assignee's previously issued U.S. Pat. No. 4,171,853 teaches a vacuum valve and controller assembly associated with a vacuum operated sewage system of the prior art. The plunger (associated with element 61 of FIG. 4) which serves to open and close the vacuum valve of that invention is cylindrical. It also has a liquid seal (associated with element 75 of FIG. 4) slideably mounted around a piston rod (associated with element 58). Common features of the prior art valve and the valve of the present invention will be described along with particular focus upon improvements in the cylindrical plunger plug and liquid seal.

Generally, this construction may be described as having a rigid, tapered plunger 61, provided with an elastomer seal along its bottom edge and is mounted on the outer end of a piston rod 58 for the opening and closing movement with respect to an internal valve stop 71. The piston operator 85 includes a two piece cylinder having a lower cup-shaped cylinder member 80 which is fixed at one of its ends to the upper cup-shaped member 83. The piston rod 58 is slideably mounted in a sliding liquid seal 75 in the lower cylinder member 80, and is secured to the base of a cup-shaped piston 84 having a diameter slightly less than the lower cylinder member 80 and biased by spring 85. A flexible diaphragm 77 is operatively positioned between the lower cylinder member 80 and upper cup-shaped member 83, and looped upwardly with the inner end secured to the base of the cup-shaped piston 84. This divides the piston operator 85 into two separate, cylindrical pressure chambers—an upper housing 83 and a lower housing 80. The control unit (not shown) is mounted on the upper end of the outer cylinder member 83.

Figure 5:
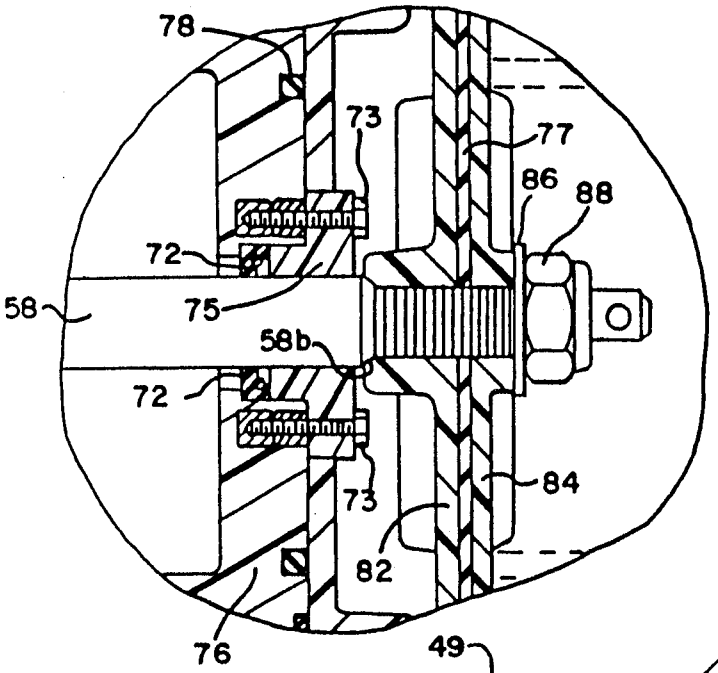
FIG. 5 is an enlarged, partial cross-sectional view of certain structural elements which effectuate sealing of the axially disposed shaft of the vacuum valve illustrated in FIG. 4.

Referring now to FIGS. 4 and 5, the vacuum valve seat and lower conical plunger assembly 70 is telescoped over the lower end of centrally disposed shaft 58. Shaft 58 is constructed of stainless steel for reliability, and is the same shaft which forms the piston driving member of prior art construction. The shaft 58 has a shoulder stop **58*a* which secures the separate individual components of the lower conical plunger assembly into their correct position for placement within the wye-body 52. As is shown in FIG. 4, locknut 54 secures stainless steel washer 59, rubber valve seat 56 and valve seat retaining member 53 onto the shaft 58. An O-ring member (not shown) nests within the rubber tapered conical plunger 61, and prevents air leakage from along the shaft 58** into the outlet vacuum conduit.

The tapered conical plunger 61 is designed to permit maximum clearance between the interior side wall of the internal valve chamber of the vacuum valve 16 and the exterior wall of the tapered plunger 61. This will permit small objects, e.g. stones, to pass through the vacuum valve 16 upon opening without being lodged therein and jamming against the interior walls of the vacuum chamber. The plastic valve seat retaining member 53 has a centrally disposed boss portion **53*a* that, when assembled, is telescoped through the rubber valve seat 56. This will define a specific preload of compression on the rubber valve seat 56 when the vacuum valve seat and lower conical plunger assembly 70 is tightened, thereby preventing overtightening of the valve seat 56. During operation of the vacuum valve 16, as the valve seat retaining member 53 seats against the O-ring seal (not shown), the O-ring seal will seal itself against the shaft 58**, which will prevent air leakage into the wye-body outlet vacuum conduit.

Referring to the end of shaft 58 opposite the plunger assembly, FIG. 5 illustrates wiper shaft seal 72. This is made from a rubber material and is placed in a beveled hole centrally disposed on the internal face of an element identified as screw plug 76. The beveled hole is designed to orient the wiper shaft seal 72 with respect to the shaft 58. The wiper shaft seal 72 has an O-ring outer edge to seal against the screw plug 76. An inner wiper lip (not shown) of the wiper shaft seal 72 prevents any contamination buildup from being packed in the void between the shaft 58 and the wiper shaft seal 72, where a biasing spring is installed.

FIG. 5 represents an enlarged, partial cross-sectional view of the elements which effectuate sealing of the axially disposed shaft 58 of the vacuum valve 16. As can be seen in FIGS. 4 and 5, replaceable bearing 75 fits within a recess formed in the face of the screw plug 76, and this permits shaft 58 to reciprocate freely without binding during operation of the vacuum valve. Bearing 75 also insures that the lower end of shaft 58 will be oriented correctly in a recess or seat found at the bottom of the wye-body 52 (shown in FIG. 4). The bearing 75 is secured to the screw plug 76 by screws 73, which connect to corresponding stainless steel inserts within the screw plug 76. The flange portion of the bearing 75 is tightened against the top face of screw plug 76.

The screw plug 76 has a recessed groove in which is placed the O-ring 78, prior to connecting the screw plug 76 to the lower housing 80. The lower housing 80 has keyed locating pins (not shown) (of differing diameters to insure correct positioning of housing 80 on screw plug 76) which nest in their respective keyed apertures located on the top face of the screw plug 76. The screw plug 76 is attached to lower housing 80 by way of screws 79 which are fastened to the stainless steel inserts within the bottom surface of lower housing 80.

The screw plug 76 and lower housing 80 are telescoped over shaft 58. Lubricant is applied to the central portion of the shaft 58. As shown in FIG. 5, the shaft 58 is threaded through piston plate 82, which rests on the tapered shoulder **58*b* of shaft 58**.

A pre-lubricated rolling diaphragm 77, is then placed over the end of shaft 58, which protrudes through piston plate 82, the bottom of the rolling diaphragm resting on the top surface of piston plate 82. Diaphragm 77 has a thick flexible outer edge for effectuating an operational, airtight seal when the vacuum valve 16 is assembled. Piston cup 84 is placed within the diaphragm 77 which is telescoped over the end of shaft 58. Washer 86 and locknut 88 act to secure the piston cup 84 to the end of shaft 58. Spring 85 is then placed into the piston cup 84. The spring 85 acts to hold the vacuum valve in the closed position (i.e., the spring provides the necessary bias which forces the vacuum valve to close at the end of one transport cycle). The upper housing 83 is then secured to the lower housing 80 by bolt 97, washer 89, lockwasher and nut 90. The rolling diaphragm 77 is positioned securely between the upper housing 83 and the lower housing 80, thereby dividing the internal vacuum chamber into two separate cylinder chambers.

The rolling diaphragm 77 will effectuate a fluid seal between each chamber.

Lubricant is applied to screw plug 76 and the assembly is then threaded into the wye-body 52, which is threaded to receive screw plug 76, with the O-ring 46 preventing leaks at the point of connection.

Accordingly, operation of the vacuum valve 16 will now be explained. As can be viewed from FIGS. 3 and 4, during operation of the vacuum valve 16, when the unit controller 99 is activated, vacuum valve 16 is opened to commence a transport cycle, and the vacuum or atmospheric pressure of the transport system will be applied to the internal dip tube 92 as a result of the system operation. Lower housing 80 will be at atmospheric pressure at all times, whether vacuum valve 16 is in the opened or closed position. Normally, when the vacuum valve is closed, the internal dip tube 92 is at atmospheric pressure. When the vacuum valve opens, however, the upper housing chamber, will be at vacuum or atmospheric pressure, the spring 85 will be compressed, and the shaft 58 will be pulled into the upper housing chamber 83, but with sufficient clearance with respect to the dip tube 92 extending down into the piston cup 84. The dip tube 92 will permit any moisture accumulation which occurs within the position cup 84 and upper housing 83 to be eliminated, as the vacuum or subatmospheric pressure is applied to the dip tube 92. During operation of the system, when the vacuum valve is in the opened position, the presence of the vacuum or subatmospheric pressure will cause the rigid, conical, tapered plunger 61 to be pulled upward into the internal valve chamber by the piston cup 84. This is because as the vacuum or subatmospheric pressure is applied against the upper chamber housing 83, diaphragm 77 is caused to be pulled up into the upper housing chamber 83, due to the pressure differential exerted by the atmospheric pressure condition in lower housing chamber 80, which, in turn, causes the piston cup 84 to likewise move up into the upper housing chamber 83. This results in the conical, tapered plunger 61 being pulled into the upper valve chamber, which in turn causes the valve seat 56 to be pulled away from the bottom of the internal valve stop 71 of the wye-body 52. When the internal dip tube 92 returns atmospheric pressure to the upper housing chamber of vacuum valve 16 in response to the unit controller 99, this process is reversed, and the valve seat 56 is engaged against the wye-body valve stop 71 to effect positive closure of the valve 16, thereby ending the transport cycle and preventing sewage from flowing. As shown in FIG. 4, the valve seat 56 is angled in construction to enable the successful engagement with the internal valve stop 71 which is integral to the wye-body 52.

Figure 6:
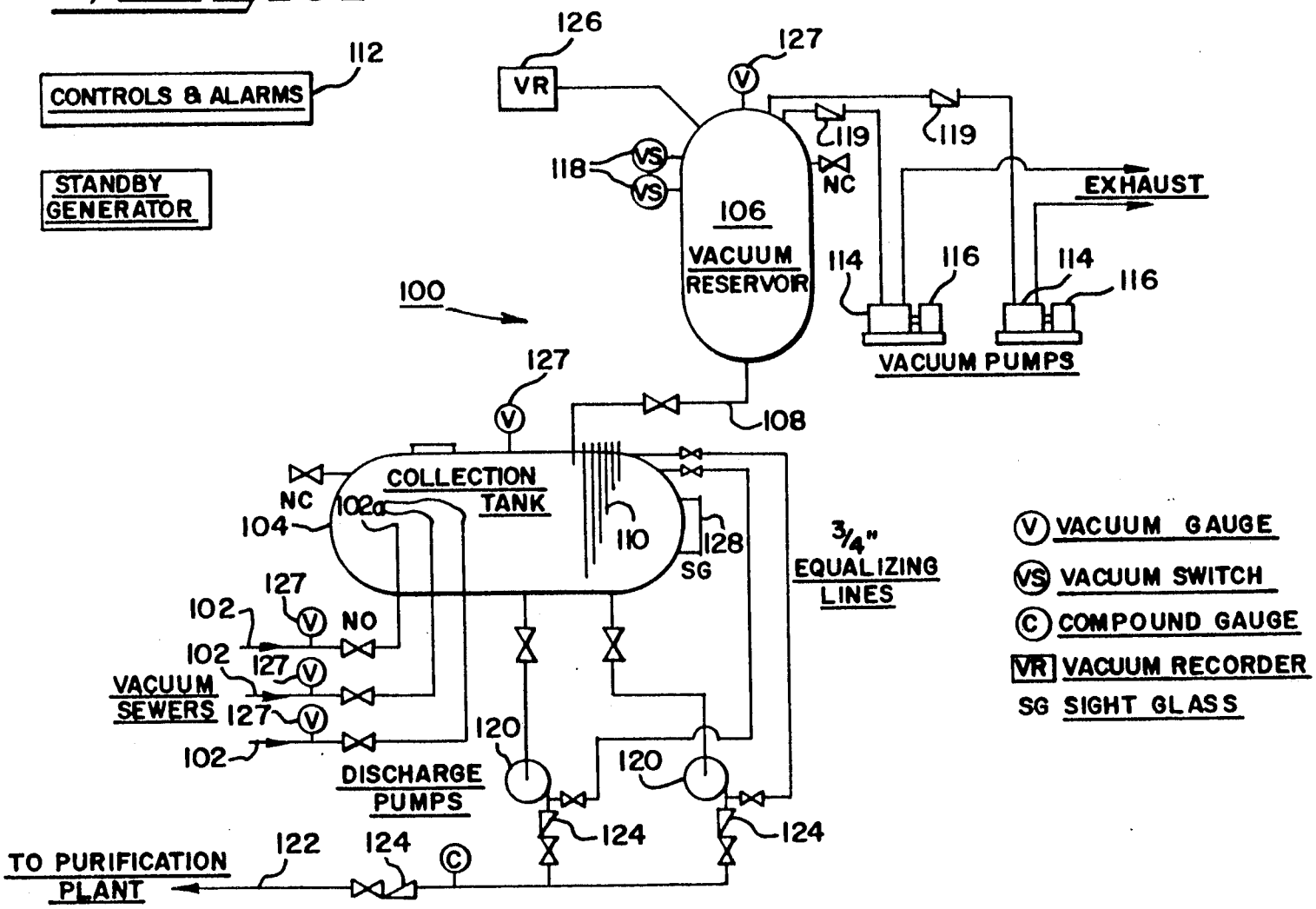
FIG. 6 is a diagrammatical representation of a vacuum collection tank and a vacuum source according to the invention.

Reverting from the vacuum valve, itself, to the overall vacuum sewerage transport system of the present invention, FIG. 6 illustrates a collection station 100 for receiving the sewage from several vacuum conduits 102. A vacuum collection tank 104 for receiving the sewage from the vacuum conduits 102 may be fabricated, for example, from welded steel or fiberglass. A vacuum reservoir 106 serves as a source of vacuum or subatmospheric pressure for the collection tank 104 and the main vacuum conduits 102, the vacuum reservoir 106 communicating with the collection tank by means of a vacuum connecting pipe 108. Level control probes 110 are provided in the sewage vacuum collection tank 104 for providing sewage depth information in the collection tank 104 to the controls and alarms circuitry 112 by appropriate connection means (not shown). Controls and alarms circuit 112 has output signals (not shown) which provide appropriate control signals for the various system components, as required. Vacuum pumps 114 driven by appropriately controlled motors 116 maintain between 16 and 20 inches of mercury vacuum in the vacuum reservoir 106 with the aid of the vacuum switches 118 and check valves 119. The vacuum pumps 114 may be, for example, of either the liquid-ring or the sliding-vane type known in the art. The discharge pumps 120 in conjunction with the level control probes 110 and the controls and alarms circuitry 112 are activated to empty the vacuum collection tank 104 contents into a pressurized sewage line 122 which feeds the sewage to an appropriate purification plant. The sewage level in collection tank 104 is always maintained at a level below the ends 102*a* of the vacuum conduits 102. This provides unobstructed communication of vacuum or subatmospheric pressure from the reservoir 106 to the conduits 102 at all times. The discharge pumps 120 may be, for example, vertical, open impeller, non-clog types which have mechanical shaft seals and oil pressurizers. Check valves 124 are installed in the discharge pump outlets and the pressurized sewage line 122. Appropriate shut-off valves are provided as shown in the collection station 100 diagrammatic representation. Alarm circuitry and indicators are included as part of circuitry 112. A vacuum recorder 126 and vacuum gauges 127 are provided to monitor vacuum pressure. A sight glass 128 is also provided for determining the sewage level within the vacuum collection tank.

While a particular embodiment of the invention has been shown and described, it should be understood that the invention is not limited thereto since many modifications may be made. It is therefore contemplated to cover by the present application any and all such modifications which fall within the true spirit and scope of the basic underlying principles disclosed and claimed herein. Moreover, this application has oriented itself towards a discussion of the preferred embodiment of the invention, viz, the transport under differential pressure of sewage. However, the word "sewage" is meant to be interpreted in its broadest sense to include any waste liquid. For example, the nonjamming vacuum valve and vacuum transport system could be combined to transport used cutting oil collected in a reservoir.

What is claimed is:

1. An improved vacuum system with a non-jamming valve for transporting waste liquids from a source at a given air pressure, comprising:

a. vacuum collection means for receiving waste liquids and having a pressure less than the pressure of the source;

b. a control valve having an open position and a closed position, comprising:

i. a valve body having an inlet coupled to the source of waste liquids, and having an outlet for injecting the waste liquids and air;

ii. a valve stop in the valve body disposed to separate the openings when said valve is in the closed position;

iii. a rigid valve plunger disposed for reciprocating movement in the valve body relative to said valve stop to alternately open and close the valve, said plunger having a first end closest to said valve stop and a second end opposite said first end, said plunger having seating means on said first end of the plunger matable with said valve stop to provide closure of the control valve, said plunger having a diameter which is progressively and sharply reduced from the first end to the second end to facilitate opening of the valve, and to eliminate jamming of the valve caused by accumulation of foreign objects; and iv. a co-axially disposed shaft connected at its first end to the first end of the rigid valve plunger and passing through the plunger, and at its second end to control means for selectively opening and closing said control valve in response to a predetermined condition of the sewage transport system; and c. conduit means coupled to the vacuum collection means and coupled to the outlet of the control valve, said conduit means having at least one riser, low point, and downslope, and being laid out in a saw-toothed fashion between the collection means and the injection means outlet so that when no flow occurs, waste liquids may collect in the low point without closure of the conduit to permit equalized pressure to be maintained throughout the conduit means.

2. The vacuum system of claim 1, wherein the waste liquid is sewage.

3. The vacuum system of claim 1, wherein the seating means for said control valve on the first end of said plunger comprises an assembly of co-axially disposed seating elements arranged to provide a generally annular beveled seating means which will eliminate the collection of foreign objects between said elements and assure valve closure.

4. The vacuum system of claim 1, wherein shaft sealing means for said control valve are provided relative to said plunger to preclude fluid leakage along the shaft when said valve is closed.

5. The vacuum system of claim 1, wherein replaceable bearing means for said control valve are provided between the rigid valve plunger and the control means for orienting the shaft and the plunger carried thereby in a predetermined angular relationship with the valve stop, and to assure closure during repetitive operations of the valve.

6. The vacuum system of claim 5, wherein sliding liquid-tight shaft sealing means for said control valve are disposed adjacent to the bearing means, the shaft sealing means being adapted to prevent the migration of fluid and fluid-borne contaminants along the shaft and into the control means.

7. The vacuum system of claim 1, wherein the source of waste liquids includes a gravity-fed holding tank.

8. The vacuum system of claim 7, wherein the waste liquids in the holding tank are exposed to atmospheric pressure, and wherein the vacuum collection means is maintained at less than atmospheric pressure.

9. An improved vacuum sewerage system for transporting an intermittently injected sewage mass, comprising:

a. at least one gravity-fed sewage conduit;

b. a collection tank fed by the gravity-fed sewage conduit for holding sewage, said sewage exposed to atmospheric pressure;

c. an intermittently operated sewage injection valve with an open and a closed position, having an inlet and an outlet, said inlet coupled to the collection tank, the valve comprising:

i. means for sealing the vacuum valve against fluid leakage to a vacuum or subatmospheric pressure outlet;

ii. means for opening and closing the vacuum valve in accordance with a predetermined pattern;

iii. a rigid plunger having a centrally disposed axis, a first end, and a second end opposite to the first end, said plunger having a diameter progressively and substantially tapered from the first end to the second end, the first end having a valve seat securely fastened thereto so as not to be pulled away from the first end during repetitive operation of the vacuum valve, said valve seat positioned at a predetermined angle to its centrally disposed axis, the second end connected to said means for opening and closing the vacuum valve; and iv. a wye-body conduit of a predetermined size, adapted to receive said substantially tapered, rigid plunger, said wye-body conduit having a first inlet opening and a second outlet opening, said first inlet opening being at atmospheric pressure, said second outlet opening being at vacuum or subatmospheric pressure, said wye-body conduit having an integral valve stop which physically engages with said plunger valve seat on the first end of said plunger when the vacuum valve is in the closed position;

d. a source of vacuum pressure;

e. a vacuum or subatmospheric collection tank having an inlet and having vacuum or subatmospheric pressure applied thereto from the source of vacuum pressure; and f. a conduit section coupled between the sewage injection valve outlet and the vacuum collection tank for transporting sewage in the form of a hollow cylinder, said conduit means being laid out in a saw-toothed fashion, having at least one riser, low point, and downslope so that when no injected sewage mass is being transported therein residual sewage may collect in the low point without closure of the conduit permitting equalized vacuum or subatmospheric pressure to be maintained throughout the conduit section.

10. The vacuum sewerage system of claim 9, wherein the means for sealing the vacuum valve comprises in combination a wiper shaft seal, a diaphragm of predetermined size having a flexible outer edge to effectuate an airtight seal, and a pair of O-rings seals of predetermined size, the diaphragm not coming into contact with said valve stop.

11. The vacuum sewerage system of claim 9, wherein the means for opening and closing the vacuum valve comprises a piston means disposed to slide in a centrally disposed vacuum chamber within said wye-body conduit.

12. The vacuum sewerage system of claim 11, wherein the piston means comprises a piston having a first end and a second end opposite the first end, said substantially tapered, rigid plunger secured to the first end of said piston.

13. A control valve for use in a vacuum transport system for conveying waste liquids, having an open position and a closed position, said control valve comprising:

a valve body having an entry opening and an exit opening;

a valve stop int he valve body disposed to separate the openings when said valve is in the closed position;

a rigid valve plunger disposed for reciprocating movement in the valve body relative to said valve stop to alternately open and close the valve, said plunger having a first end closest to said valve stop and a second end opposite said first end, said plunger having seating means on said first end of the plunger matable with said valve stop to provide closure of the control valve, said plunger having a diameter which is progressively and sharply reduced form the first end to the second end; and a coaxially disposed shaft connected at its first end to the first end of the rigid valve plunger and passing through the plunger, and at its second end to control means for selectively opening and closing said control valve in response to a predetermined condition of the waste liquid transport system, whereby the substantially tapered plunger of said control valve allows waste liquids to be transported through said control valve as part of the vacuum transport system without jamming of the valve caused by accumulation of foreign objects in the waste liquids, and facilitates opening of the valve.

14. The control valve of claim 13, wherein the waste liquids are sewage.

15. The control valve of claim 13, wherein the seating means on the first end of said plunger comprises and assembly of coaxially disposed seating elements arranged to provide a generally annular beveled seating means which will eliminate the collection of foreign objects between said elements and assure valve closure.

16. The control valve of claim 13, wherein shaft sealing means are provided relative to said plunger without coming into contact with said valve stop, to preclude fluid leakage along the shaft when said valve is closed.

17. The control valve of claim 13, wherein replaceable bearing means are provided between the rigid valve plunger and the control means for directing the shaft and the plunger carried thereby in a predetermined angular relationship with the valve stop and to assure closure during repetitive operations of the valve.

18. The control valve of claim 17, wherein sliding liquid-tight shaft sealing means are disposed adjacent to the bearing means, the shaft sealing means being adapted to prevent migration of fluid and fluid-borne contaminants along the shaft and into the control means.

* * * * *

Disclaimer 5,078,174—John M. Grooms; Mark A. Jones, both of Rochester, Ind. VACUUM SEWERAGE SYSTEM HAVING NON-JAMMING VACUUM VALVES WITH TAPERED PLUNGERS. Patent dated January 7, 1992. Disclaimer filed December 18, 1995, by the assignee, Burton Mechanical Contractors, Inc.

Hereby disclaims and dedicates to the Public all claims and entire term of said patent.

*(Official Gazette, June 10, 2003)*